United States Patent [19]

Neher

[11] 4,284,881

[45] Aug. 18, 1981

[54] DIGIT WHEEL COUNTER

[75] Inventor: Hans Neher, Hausen, Fed. Rep. of Germany

[73] Assignee: J. Hengstler K.G., Aldingen, Fed. Rep. of Germany

[21] Appl. No.: 107,035

[22] Filed: Dec. 26, 1979

[30] Foreign Application Priority Data

Jan. 8, 1979 [DE] Fed. Rep. of Germany ..... 2900415

[51] Int. Cl.[3] ..... G06C 15/42

[52] U.S. Cl. ..... 235/1 C; 235/117 A; 235/144 B; 235/144 HC

[58] Field of Search ..... 235/1 C, 10, 130 R, 235/133 R, 134, 137-139 R, 142, 143, 144 DM, 144 PN, 144 ME, 144 HC, 144 SM, 144 R, 144 B, 117 A

[56] References Cited

U.S. PATENT DOCUMENTS

| | | | |
|---|---|---|---|
| 3,531,047 | 9/1970 | Pfeiffer | 235/144 HC |
| 3,670,152 | 6/1972 | Kratt | 235/144 HC |
| 3,711,684 | 1/1973 | Zielke | 235/144 HC |
| 3,811,032 | 5/1974 | Neher | 235/1 C |
| 4,028,530 | 6/1977 | Bud et al. | 235/144 HC |

*Primary Examiner*—L. T. Hix
*Assistant Examiner*—Benjamin R. Fuller
*Attorney, Agent, or Firm*—Balogh, Osann, Kramer, Dvorak, Genova & Traub

[57] ABSTRACT

An improved mechanical counter including digit wheel means stepping pinion means which are movable between first and second positions, engaging and disengaging, respectively, the digit wheel means, and a resetting mechanism including a resetting rake, which is pivotally movable between an initial position in which rake is clear of the digit wheel means, and an actuated position.

Also included in the resetting mechanism are a slider member connected to a pivoted member, which at its end opposite to the slider member is pivoted on a stationary pivot pin. Remote from its pivot pin, the pivoted member has a U-shaped coupling recess for actuating the resetting rake, and an S-shaped cam slot for disengaging the pinion means from, or re-engaging the same with, the digit wheel means, respectively. The resetting rake carries a coupling pin that is engaged by a respective edge of the pivoted member at the U-shaped coupling recess thereof. The pivoted member is adapted to cooperate with the coupling pin only when the pinion means are in their first and second positions. Resilient means are also provided to yieldably hold the rake in its initial and actuated positions.

11 Claims, 6 Drawing Figures

DIGIT WHEEL COUNTER

Figure 1:
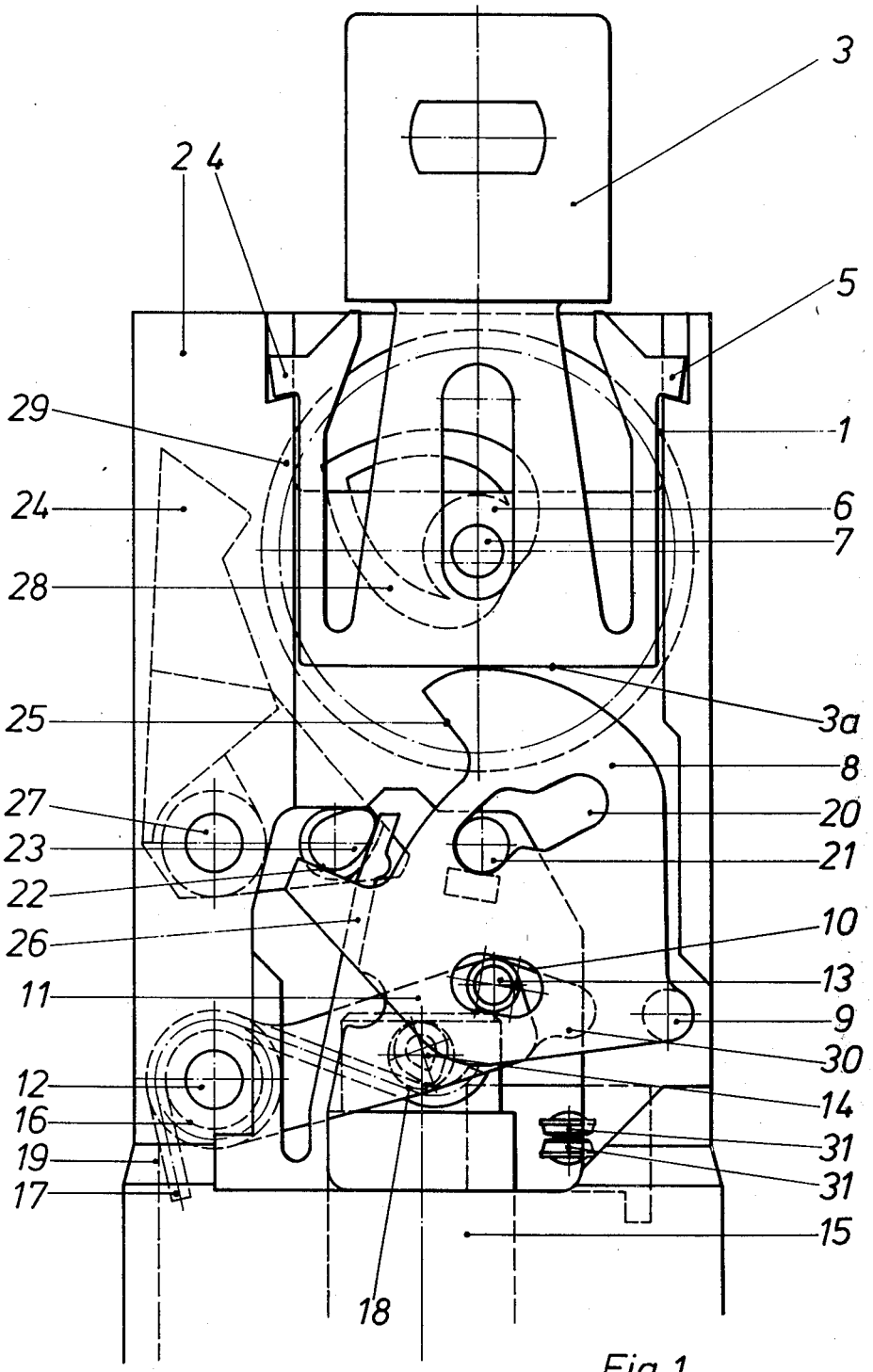

This invention relates to a digit wheel counter, particularly to a resetting merchanism for a digit wheel counter in which the digit wheels interengage with stepping pinions and resetting sliders are provided, which are operable to actuate means for disengaging the pinions from said digit wheels and to actuate resetting elements. For a reliably controllable zeroing or resetting operation, it is desired to hold the digit wheels exactly in the position to which they have been reset until the digit wheels have been re-engaged by the stepping pinions, which had been disengaged. The pinion axle must be held against rotation during its displacement so that the rotational position of the pinions will not be changed as they re-engage the digit wheels.

Known resetting mechanisms for mechanical counters in which the digit wheels mesh with stepping pinions comprise resetting sliders, which are operable to actuate means for disengaging the pinions and to actuate resetting elements consisting of claws or rakes. The resetting slider comprises a spring having a slot for frictionally driving the pinion axle, which is fitted at its end into the slot. This arrangement is intended to ensure a disengagement and re-engagement of the stepping pinions in the proper sequence (German Patent Publication No. 22 03 257). The tolerances which are inevitable in the manufacture of such frictional coupling elements may give rise to differential frictional forces so that the resetting operations may not be performed reliably and in the proper sequence. Besides, the frictional forces may change to such an extent during a prolonged time under the influences only of temperature and/or climate that counters which operated properly when new become subsequently unreliable, particularly if the resetting mechanism is electromechanically actuated.

It is an object of the invention to provide such a resetting mechanism in which the disengagement of the pinions and the pivotal movement of the resetting rake to the engaging position are positively effected so that undesired movements of the digit wheels are avoided.

In the resetting mechanism for digit wheel counters according to one embodiment of the invention, the resetting slider is connected to a pivoted member, which at its end opposite to the slider member is pivoted on a stationary pivot pin and which comprises an arcuate portion extending toward the slider member. Remote from its pivot pin, the pivoted member has a coupling recess for actuating the resetting rake and an S-shaped cam slot for disengaging the pinions from the digit wheels and for re-engaging the pinions with the digit wheels. The pivoted member is pivoted by the pivot pin in the housing remote from its the power-transmitting portions and has a curved surface, which contacts the flat end portion of the slider. The pivoted member has also a U-shaped recess for engaging a coupling pin of a pivoted resetting rake. The pivoted member is formed with an S-shaped cam slot, in which the pinion shaft is guided. The extent of the recess in the direction of the pivotal movement of the pivoted member exceeds the largest diameter of the coupling pin so that the resetting rake cannot be acted upon by the pivoted member unless the stepping pinions have been moved from the digit wheels as far as possible or have re-engaged the digit wheels. The resetting rake is held in its end positions by resilient detent means.

The pivoted member which is pivoted on a stationary axis on one side may be connected to the armature of a resetting solenoid by a transmitting lever, which is pivoted at its opposite end on a stationary axis and is connected to the pivoted member by a pin-slot coupling. In this arrangement the force is transmitted from the armature of the resetting solenoid with a mechanical advantage.

Figure 2:
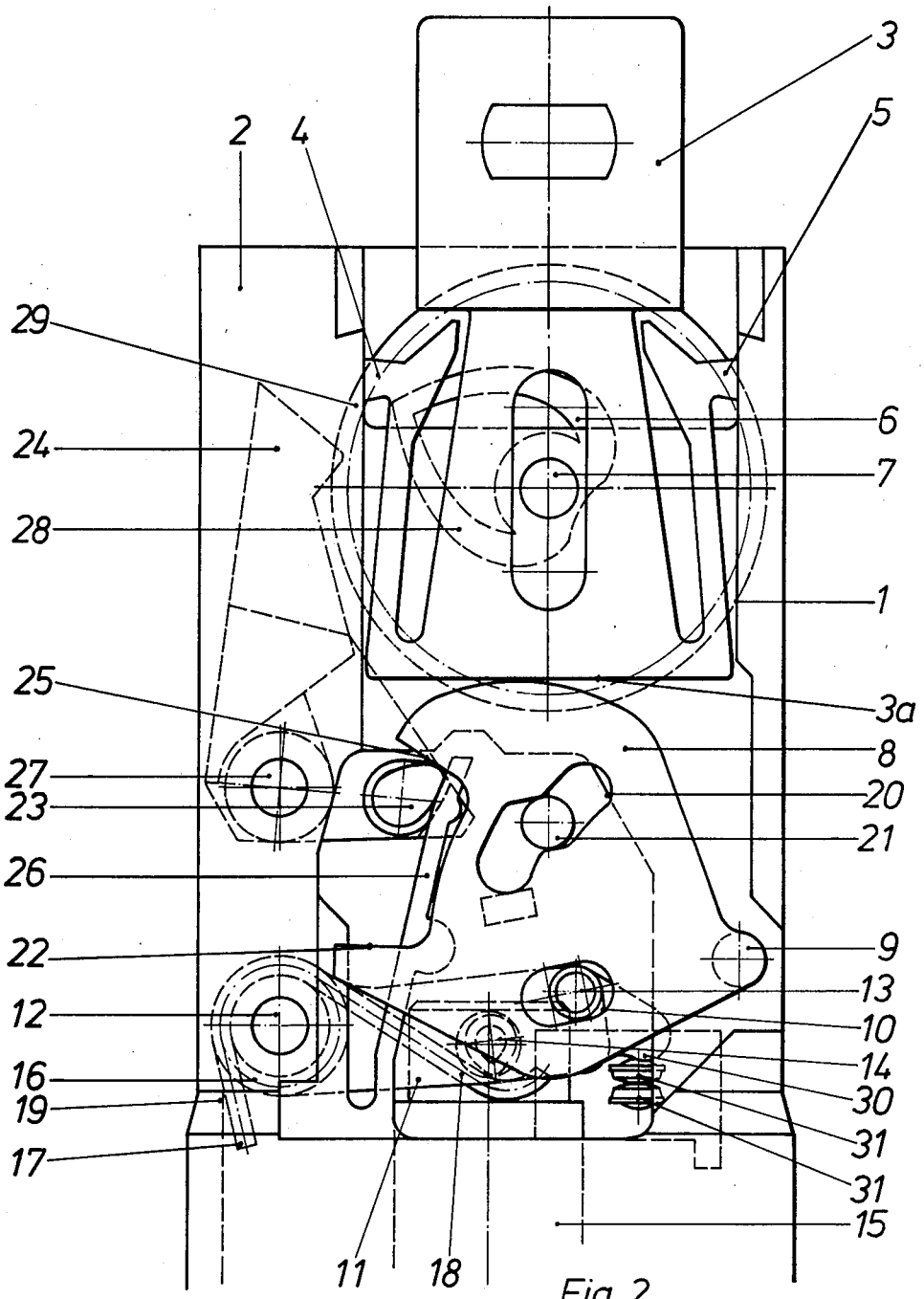
Figure 3:
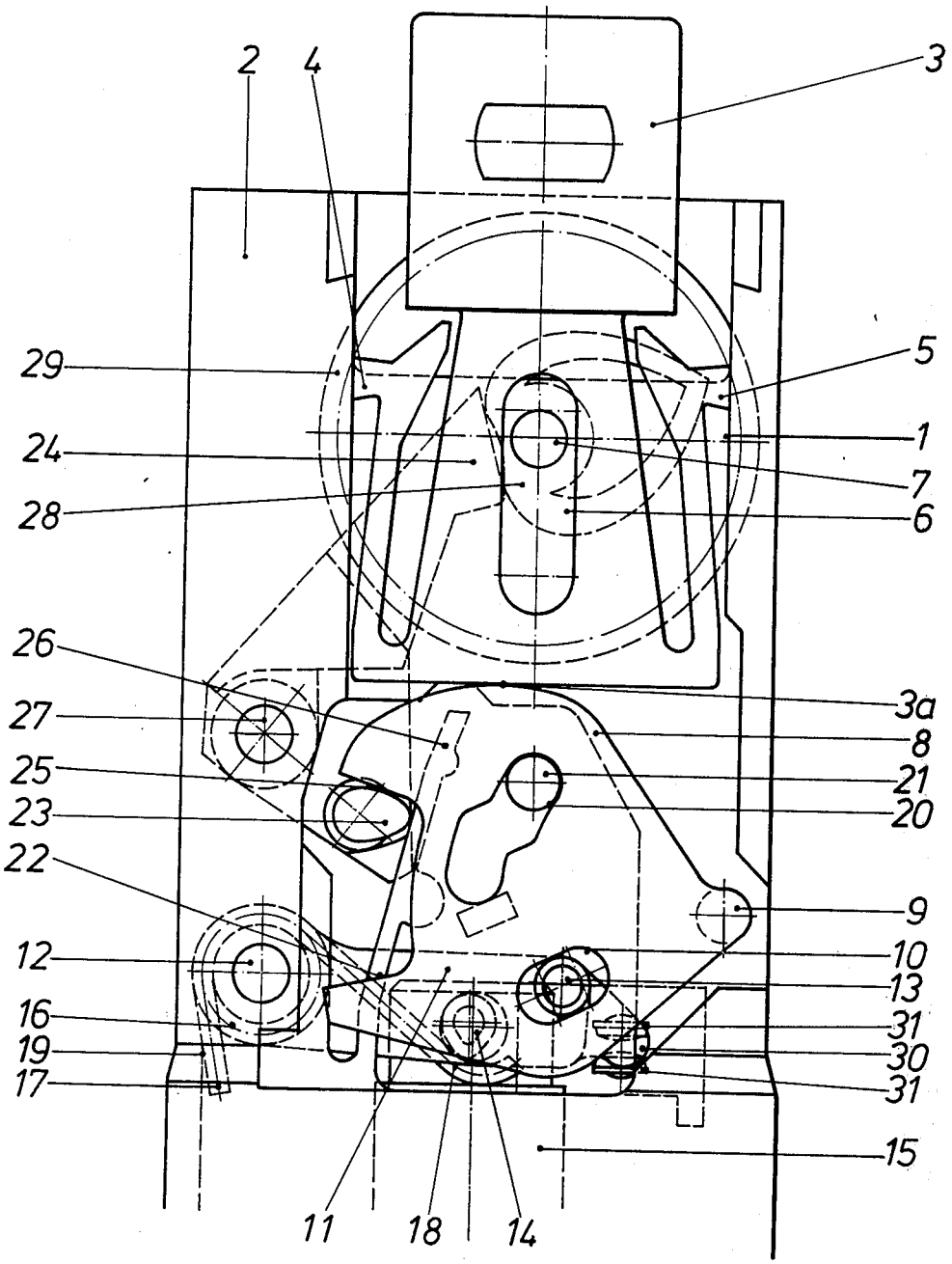
Figure 4:
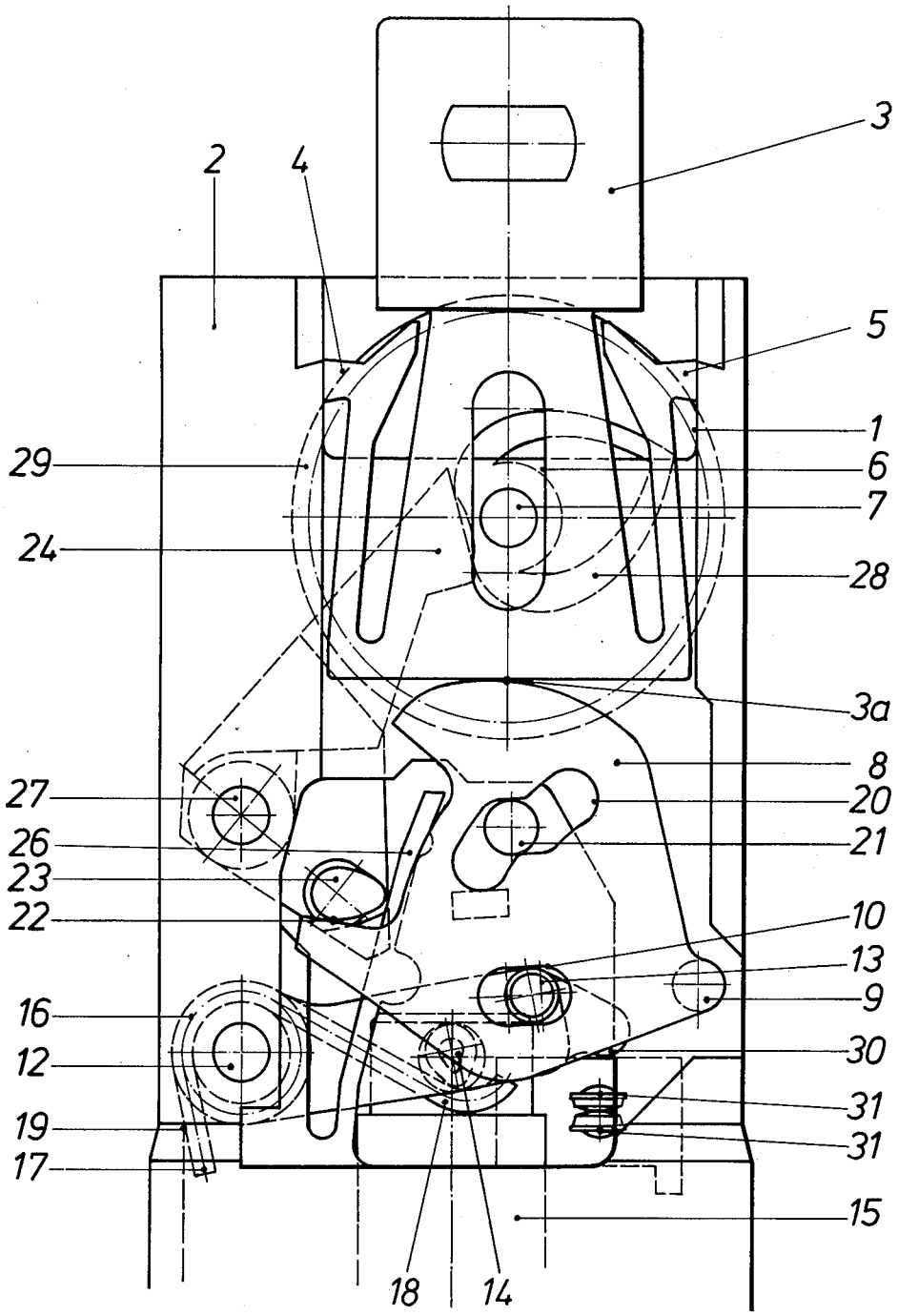

Further details of the resetting mechanism according to the invention will become apparent from the following description of two preferred embodiments shown by way of example on the drawings, in which FIG. 1 shows a first embodiment of the resetting mechanism in position of rest, FIG. 2 shows the mechanism of FIG. 1 with the resetting slider partly depressed, FIG. 3 shows the resetting mechanism of FIG. 1 with the resetting slider completely depressed and FIG. 4 shows the resetting mechanism of FIG. 1 with the resetting slider partly returned.

Figure 5:
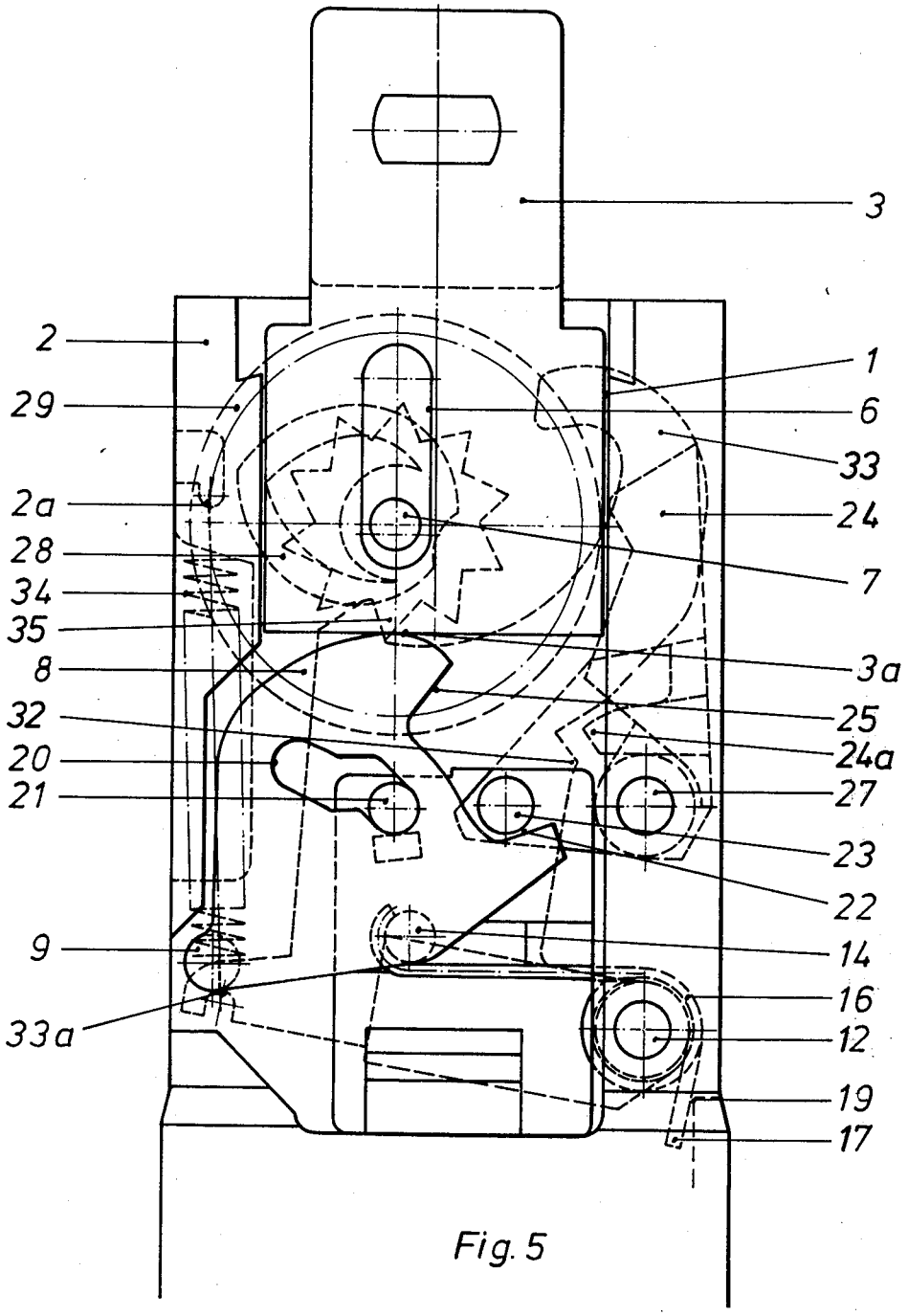
Figure 6:
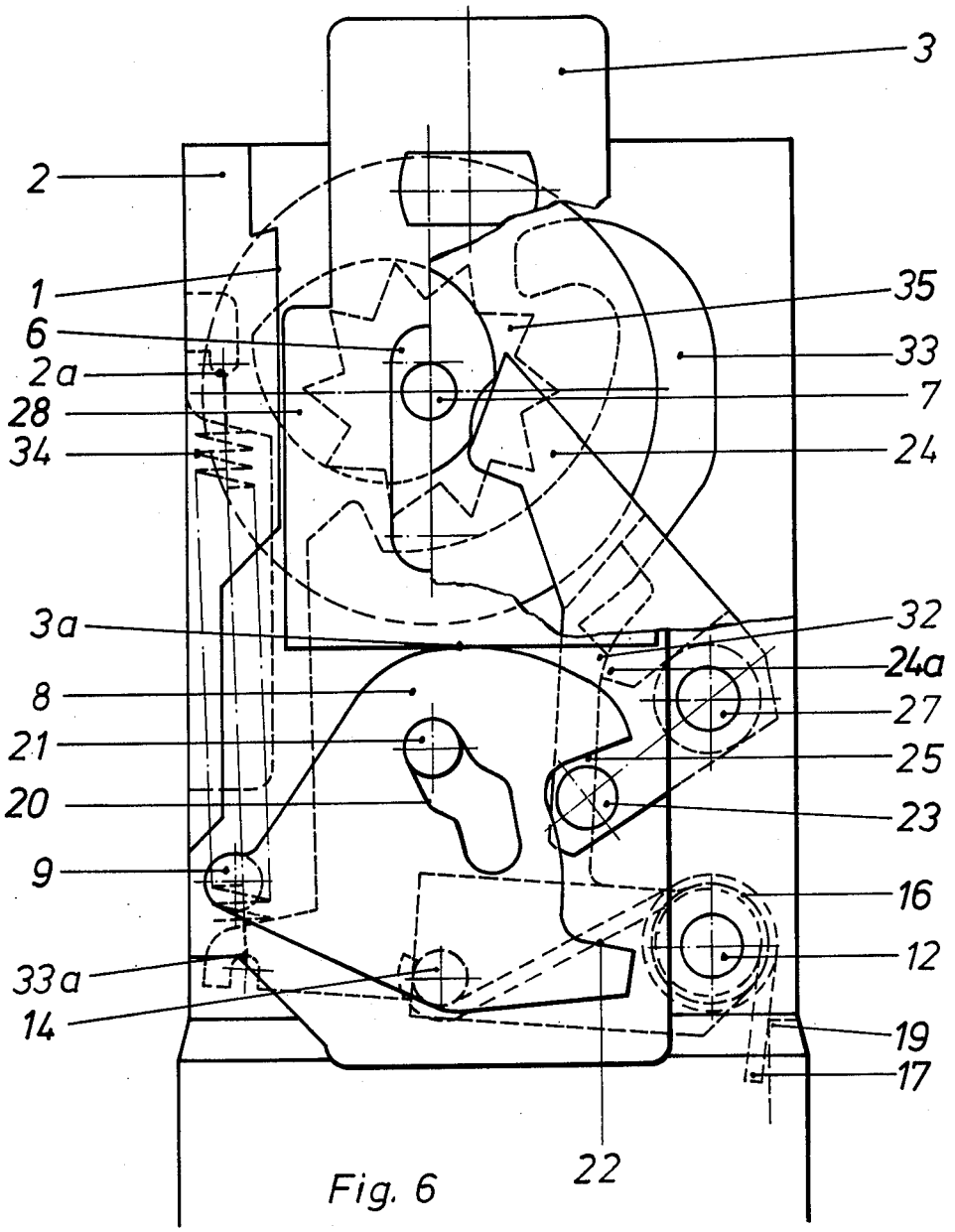

FIG. 5 shows a second embodiment of the resetting mechanism in position of rest and FIG. 6 the resetting mechanism of FIG. 5 with the resetting slider partly depressed.

The resetting mechanism according to the invention will now be explained with reference to the first embodiment shown in FIGS. 1 to 4. The mechanism is shown in position of rest in FIG. 1. The resetting key or slider 3 is guided in a guide 1 provided in the housing 2. To prevent an inadvertent actuation of the slider 3, the latter is held in position by detent tongues 4, 5 which are integral with the slider 3 and provided on opposite sides thereof.

These detent elements 4, 5 on opposite sides of the slider 3 resist the movement of the slider 3 and when their resistance is overcome they yield inwardly to permit a movement of the slider 3. The movement of the slider 3 is limited by a longitudinal slot 6, which is formed in the slider 3 and receives a stationary digit wheel axle 7, which is mounted in the housing 2. To ensure that the resetting operations will be performed in the proper sequence, a pivoted member 8 is pivoted in the housing 2 by a pivot pin 9 and has an arcuate portion extending to the resetting slider 3.

When the resetting slider 3 is actuated by hand, its lower edge 3*a* in contact with the arcuate portion of the pivoted member 8 actuates the latter. When resetting is electrically controlled, the pivoted member 8 is driven by a resetting solenoid. To this end a transmitting lever 11 is provided, which is mounted in the housing 2 on a stationary axle 12. The transmitting lever 11 is provided with a coupling pin 13, which engages the coupling slot 10 of the pivoted member 8 and a pin 14, which is hooked into the plunger-type armature 15 of the resetting solenoid, not shown in more detail. The torsion spring 16 wound on the axle 12 has a spring arm 17, which bears on the housing 2 at 19, and a prestressed second spring arm 18, which engages the hooked-in pin 14 so that the transmitting lever 11 and the pivoted member 8 are spring-urged to their upper position.

The pivoted member 8 is formed with an S-shaped cam slot 20, which receives the pinion axle 21 and serves to control the movements of the latter in the proper sequence.

In the position of rest shown in FIG. 1, the coupling edge 22 of the pivoted member 8 engages the oval coupling pin 23 of the resetting rake 24. As is apparent from FIG. 2, a flat spring 26, which is integral with the housing 2, constitutes a detent element which engages the coupling pin 23 to hold the resetting rake 24 in its initial position although the resetting slider 3 has already been shifted to a position in which the coupling edge 22 of the pivotally moved pivoted member 8 has disengaged the coupling pin 23. In the position shown in FIG. 2, the axle 21 is in a position in which the pinions, not shown, which are rotatably mounted on the axle 21, are disengaged from the digit wheels but the resetting rake 24 is still in its initial position.

As the resetting operation proceeds, the coupling edge 25 engaging the coupling pin 23 imparts a pivotal movement to the resetting rake 24 about its pivotal axis 27 and together with the cardioid cams 28 causes the digit wheels 29 to be reset. Owing to the S-shaped curved slot 20, the pivoted member 8 can perform a pivotal movement to such an extent that the resetting rake 24 can complete its resetting movement without a change of the position of the disengaged pinion axle 21 until the resetting mechanism has reached the position shown in FIG. 3, in which the digit wheels have been reset.

In the position shown in FIG. 3, the coupling pin 23 of the resetting rake 24 has reached the lower portion of the detent spring 26 so that the switch-actuating nose 30, which constitutes an extension of the transmitting lever 11, actuates the stationary switch 31 mounted in the housing 2. As a result, the switch 31 delivers a signal which indicates that the digit wheels have been reset. In response to that signal the power of the solenoid is to be changed from an actuating value to a holding value.

It is apparent from FIG. 4 that the pivoted member 8 permits the movement of the pinion axle 21 to the engaging position while the digit wheels 29 are held in position by detent means. At the same time, the switch 31 returns to its initial position. When the pinion axle 21 has been positively moved to its engaging position by the S-shaped cam slot 20, the coupling edge 22 and coupling pin 23 cooperate to return the resetting rake 24 to its initial position so that the position shown in FIG. 1 has been re-established.

Another embodiment is shown in FIGS. 5 and 6 in mirror symmetry to FIGS. 1 to 4. In the embodiment shown in FIGS. 5 and 6, the detent means cooperating with the resetting rake 24 comprise a cam **24*a* provided on a detent edge 32 of a stepping rocker 33 rather than by a detent spring 26. As is apparent from FIG. 5, the resetting rake 24 is held in initial position by the coupling edge 22 when the resetting mechanism is in position of rest. The stepping rocker 33 is then freely movable. A tension spring 34 is connected at opposite ends to a hook 33*a* of the stepping rocker and to a hook 2*a* of the housing and in known manner holds the stepping gear 35 in the position to which the gear 35 has been moved in the second half-step under the action of the tension spring 34**.

The operations performed after the actuation of the resetting mechanism has been initiated are apparent from FIG. 6. When the pinion axle 21 has been moved to a disengaged position by the pivoted member 8, the coupling edge 25 and the coupling pin 23 cooperate to impart a pivotal movement to the resetting rake 24. The cam **24*a* formed on the resetting rake 24 and the detent edge 32 of the stepping rocker 33 cooperate to move the stepping rocker 33 to an intermediate position, in which the rocker 33 is clear of the stepping gear 35 so that the first of the digit wheels 29 can be reset; that first digit wheel is integral with the stepping gear 35**.

Under the action of the tension spring, the overlapping detent edges 32 of the stepping rocker 33 and the cam **24*a* of the resetting rake 24 cooperate to hold the latter in position until the pinion axle 21 has been moved to the engaging position and as the resetting mechanism is subsequently moved to its initial position and the coupling edge 25 causes the resetting rake 24** to be swung back from its detent-held position to its initial position.

In the embodiment shown in FIGS. 5 and 6, an electrically actuated resetting is not intended so that the parts required for that purpose have been omitted.

What is claimed is:

1. In a mechanical counter comprising digit wheel means, stepping pinion means movable between first and second positions, in which said pinion means engage and disengage, respectively, said digit wheel means, and a resetting mechanism comprising a resetting rake which is movable between an initial position, in which said rake is clear of said digit wheel means, and an actuated position, and is arranged to reset said digit wheel means by a movement from said initial to said actuated position, a pivoted member which is pivoted on a first stationary axis and has eccentric portions operatively connected to said pinion means and said rake, and actuating means which are operatively connected to said pivoted member and operable to move by means of said pivoted member said pinion means from said first position to said second position and back to said first position and to move by means of said pivoted member said rake to said actuated position when said pinion means are in said second position and subsequently to move said rake back to said initial position by means of said pivoted member the improvement residing in that said pivoted member comprises an S-shaped cam slot and a U-shaped recess, said pinion means comprise a pinion-carrying axle, which engages said cam slot, said rake is pivoted on a second stationary axis and carries a coupling pin extending into said recess and is pivotally movable between said initial and actuated positions, said recess has in the direction of the pivotal movement of said pivoted member about said first axis an extent which exceeds the diameter of said coupling pin so that there is lost motion between said coupling pin and said pivoted member, said pivoted member is adapted to cooperate with said coupling pin only when said pinion means are in said first and second positions, and resilient means are provided which tend to yieldably hold said rake in its initial and actuated positions.

2. The improvement set forth in claim 1, in which said pivoted member has a convexly curved surface and said actuating means comprise a slider having a flat end portion in frictional contact with said curved surface and operable to actuate said pivoted member, and spring means urging said slider and said pivoted member to a position of rest, said pivoted member being arranged to move said pinion means to said first position and said rake to said initial position as said pivoted member is moved to said position of rest.

3. The improvement set forth in claim 2, in which said slider is provided on opposite sides with resilient detent tongues which oppose an inadvertent operation of said slider and are capable of yielding inwardly in response to a sufficiently strong force exerted on said slider.

4. The improvement set forth in claim 1, in which said actuating means comprise a resetting solenoid having a plunger-type armature and a transmitting lever which is pivoted on a second stationary axis and is connected at one end to said armature and at the other end by a pin-slot coupling to said pivoted member.

5. The improvement set forth in claim 4, in which a switch is provided, which is operable to change the power of said solenoid from an actuating value to a holding value and said transmitting lever carries a nose and is arranged to actuate said switch by said nose when said solenoid has been actuated to move by means of said transmitting lever and said pivoted member said pinion means to said second position and said actuating lever to said actuated position.

6. The improvement set forth in claim 1, in which said coupling pin is oval in cross-section and said resilient means comprise a stationary flat detent spring engaging said coupling pin.

7. The improvement set forth in claim 6, in which said flat spring is adapted to hold said coupling pin in two positions on opposite sides of a line connecting said first and second axes.

8. The improvement set forth in claim 1, in which said pivoted member is operable to move said rake from said initial position to a position between said initial and actuated positions when said pinion means are in said first position, to subsequently move said pinion means from said first position to said second position when said rake is in a position between said initial and actuated positions and to move said pinion means from said second position to said first position when said rake is in said actuated position.

9. The improvement set forth in claim 8, in which said slot has a portion arranged to receive said pinion means in said first position thereof and said portion extends at such an angle to a line connecting said first and second pivotal axes that said pivoted member is adapted to exert a self-locking action holding said pinion means in said first position.

10. The improvement set forth in claim 1, in a counter in which said digit wheel means comprise a stepping gear, wherein said rake carries cam means, a stepping rocker is provided, which is engageable with said stepping gear and operable to step said digit wheel means, and said cam means are arranged to move in response to a movement of said rake from said initial position toward said actuated position said rocker to an intermediate position, in which said rocker is clear of said stepping gear and adapted to hold said rake in said actuated position.

11. The improvement set forth in claim 1, in which said actuating means are operable to move said pinion means from said first position to said second position and to move said rake from said initial position to said actuated position by a movement of said pivoted member in a first direction from a predetermined position of rest and to move said pinion means from said second position to said first position and to move said rake from said actuated position to said initial position by a movement of said pivoted member to said position of rest in a second direction, which is opposite to said first direction, and said actuating means comprise biasing means tending to move said pivoted member in said second direction to said position of rest.

* * * * *